US005449011A

United States Patent [19]

Jacobus et al.

[11] Patent Number: 5,449,011

[45] Date of Patent: Sep. 12, 1995

[54] DISH WASHING MACHINE WITH IMPROVED WASH MECHANISM

[75] Inventors: Dwight W. Jacobus; Roger L. Hoffman, both of Louisville, Ky.

[73] Assignee: General Electric Company, Louisville, Ky.

[21] Appl. No.: 133,322

[22] Filed: Oct. 8, 1993

[51] Int. Cl.[6] ..... B08B 3/02

[52] U.S. Cl. ..... 134/176; 134/179; 239/227; 239/261

[58] Field of Search ..... 134/179, 176, 200; 239/227, 243, 251, 261, 264

[56] References Cited

U.S. PATENT DOCUMENTS

| | | | |
|---|---|---|---|
| 1,392,476 | 10/1921 | Boedeker | 239/251 X |
| 1,408,077 | 2/1922 | Clinton | 134/179 UX |
| 1,592,452 | 7/1926 | Ferris et al. | 239/251 X |
| 1,639,389 | 8/1927 | Todd | 239/251 X |
| 1,965,912 | 7/1934 | Strawn | 239/251 X |
| 2,127,778 | 8/1938 | Lewis | 134/179 X |
| 2,275,189 | 3/1942 | Wieghart | 134/186 |
| 2,440,161 | 4/1948 | Vaudreuil | 134/179 X |
| 2,596,693 | 5/1952 | Karlstrom | 134/179 X |
| 2,918,927 | 12/1959 | Clearman | 134/179 |
| 2,991,942 | 7/1961 | Rosenkranz | 239/251 |
| 3,042,318 | 7/1962 | Chow et al. | 239/251 X |
| 3,092,329 | 6/1963 | Twaroch | 239/243 X |

FOREIGN PATENT DOCUMENTS

| | | | |
|---|---|---|---|
| 879707 | 3/1940 | France | 134/176 |
| 410310 | 10/1966 | Switzerland | 134/179 |

*Primary Examiner*—Frankie L. Stinson
*Attorney, Agent, or Firm*—H. Neil Houser

[57] ABSTRACT

An automatic domestic dish washing machine has a chamber for the items to be washed and a pump to pressurize the washing fluid. A spray arm includes elongated top and bottom walls encompassing an elongated passageway to receive the pressurized fluid. A spray device has an elongated body with a passageway and an exit opening at each end of the passageway. A hollow support shaft extends perpendicular to the body and includes a passageway communicating with the body passageway. The shaft is mounted in the spray arm with lateral openings in the shaft communicating with the passageway in the arm so that fluid flows through the arm, shaft and body and sprays out through the exit openings. The lower portion of the shaft is cylindrical and extends through an opening in the bottom wall of the arm. A bearing mounted to the arm includes a longitudinal opening surrounding the lower portion of the shaft and spaced from it to define an annulus with a width just greater than the size of hard waste particles likely to be entrained in the wash fluid. A thrust washer is attached to the shaft below the bearing. When pressurized fluid flows through the spray device the shaft lifts and the washer engages the bearing and centers the shaft in the longitudinal opening. When pressurized fluid is not flowing, the shaft lowers and the thrust washer is spaced below the bearing a distance greater than the width of the annulus between the bearing and the shaft.

18 Claims, 3 Drawing Sheets

DISH WASHING MACHINE WITH IMPROVED WASH MECHANISM

BACKGROUND OF THE INVENTION

Automatic dishwashers normally are either designed and intended for use in homes (referred to as domestic machines) or are designed and intended to be used in restaurants and similar establishments (referred to as commercial machines). Commercial machines normally use high pressure washing fluid (water with a detergent for cleaning and water, with or without a rinse agent, for rinsing), often in the range of 10 psi to 20 psi. Because of the delicacy of many items washed in domestic machines, they normally use low pressure washing fluid, often in the range of 2 psi to 8 psi.

A typical present day domestic dish washing machine has an elongated main spray arm positioned in the lower part of the wash chamber and rotated by pressure of the washing fluid to spray the fluid on the items to be washed. Generally a number of ports or orifices positioned across its upper wall spray the fluid generally upward over the items to be washed. Normally these ports are angled from the vertical in a symmetrical pattern so that the reaction force of the fluid jets spraying from them produce very little, if any, rotary force on the arm. The arm also has one or two small reaction or drive ports, toward the outer ends of the arm, angled so that fluid exiting from them will cause the arm to rotate. Such reaction ports also may spray fluid over the filter to clean it, as is well known in the art.

The reaction torque or force exerted on the spray arm by the fluid flowing from the reaction ports causes the arm to accelerate until an equilibrium speed is reached. Assuming a single drive jet, the drive or reaction torque can be expressed, in simplified terms, as a constant times the diameter of the jet squared times the fluid pressure. It will be understood that only a portion of the torque, depending on the angle of the jet, causes the arm to rotate.

The drive torque is opposed, and an equilibrium speed is obtained, by two opposing torques or forces. First the mounting of the arm has a resistance or friction torque. In order to control such friction and provide smooth, long life operation the mounting normally is through a bearing mechanism. The bearing friction torque can be expressed, in simplified terms, as the net force on the bearing times the coefficient of friction of the bearing times the radius through which the force acts. Second, as the arm rotates the fluid in the each part of the arm must travel a greater linear distance during a unit of time than water closer to the axis of rotation. The force required to provide this acceleration of the fluid, referred to as the coriolis force, tends to slow down the rotation of the arm. The coriolis force or torque can be expressed, in simplified terms, as the mass flow times the radius from the axis of rotation to the exit opening for the fluid times the angular velocity of the arm.

It will be noted that only the coriolis torque is dependent upon the speed of the arm. Thus, as the arm accelerates, the coriolis torque increases until the bearing friction torque plus the coriolis torque equals the drive torque. The system is then balanced and the arm maintains an essentially steady state speed. The design speed easily can be varied by varying the fluid pressure as well as the size of the drive port and its angle relative to a tangent of the circumference of the arm's motion. Domestic dish washing machines are very competitive and it is not practical to provide high cost, close tolerance bearing mechanisms for the spray arms. Thus the friction torque of a particular design dish washing machine may vary significantly from one individual machine to another. In addition, small food particles and other pieces of debris are commonly entrained in the washing fluid and can enter the bearing mechanism, causing the friction to change significantly for at least some period of time. Such variations in the bearing friction torque will result in the spray arm rotating at a different equilibrium speed, either faster or slower than the nominal design speed. To compensate for such variations it is desirable to provide a nominal or design coriolis torque that is at least twice as large as the nominal or design bearing friction torque.

In machines which spray fluid from a long main spray arm, the effects of the changes in the bearing friction torque can be compensated for easily. First, the design of the drive ports or orifices can assure that the drive torque is significantly larger than the bearing friction torque. Second, since the arm is rather long, often in the vicinity of twenty-two inches and the amount of fluid flowing is large, the coriolis torque also is very large compared to the friction torque. Thus variations in the speed of the arm resulting from variations in the bearing friction torque can easily be maintained in an acceptable range.

Such long spray arms have a number of problems. For example washing dishes with such an arm uses a very large volume of fluid in order to keep the pump primed. Effective washing could be obtained with significantly less fluid by using a small spray device which is rotatably mounted adjacent the end of a long rotating main arm in which fluid is sprayed only from the small device for washing purposes, it being understood that the main arm would be rotated by a drive jet. In the past such an approach has been attempted but with limited success, particularly in domestic machines. One reason is that the spray device is much shorter, perhaps on the order of seven inches. This limits the coriolis torque, particularly in machines with relatively low fluid mass flow, as is typical in domestic machines. Therefore, the bearing friction torque was large compared to the coriolis torque and was the determinative torque in balancing the drive torque. Two substandard operation modes were clearly possible in such machines. First, if the bearing torque of a particular machine became large compared to its nominal design value, as if a hard piece of debris entered the bearing mechanism, the spray device would stop rotating and the washing process would be ineffective. Second, if the bearing friction were somewhat less than the nominal design value, the spray device would reach a very high speed before the coriolis torque rose enough that the drive torque was offset. At such high speeds the fluid leaving the spray device was likely to break up into an ineffective mist.

SUMMARY OF THE INVENTION

A key to the successful operation of a spray system employing a small spray device rotating near the terminus of a longer rotating main arm is to assure that the coriolis torque is significantly larger than the bearing friction torque. Since the spray device is relatively short the coriolis torque will be much smaller than available with a long spray arm that extends substantially across the chamber. Thus a key to obtaining such a torque relationship is to limit the bearing friction torque to a very low value. A key to reducing the bearing friction is reducing the radius over which the pressure force acts on the bearing. Another key is to prevent small hard particles of debris form significantly increasing the bearing friction.

It is an object of the present invention to provide an improved domestic dish washing machine in which the washing fluid is sprayed from a spray device rotating adjacent the outer end of a longer rotating main arm.

Another object is to provide such an improved machine in which the coriolis torque is at least about twice the bearing friction torque.

Yet another object is to provide such an improved machine in which the working radius of the bearing supporting the spray device is minimized.

Still another object of this invention is to provide such an improved machine in which the fluid is supplied to the spray device from the main arm through a hollow shaft.

Still another object of this invention is to provide such an improved machine in which the spray device is mounted on the main spray arm by means of a self centering bearing mechanism.

Yet another object of this invention is to provide such an improved machine in which the bearing mechanism tolerates hard debris particles likely to be entrained in the washing fluid and is self draining at the conclusion of a washing operation.

DETAILED DESCRIPTION OF PREFERRED EMBODIMENT

Figure 1:
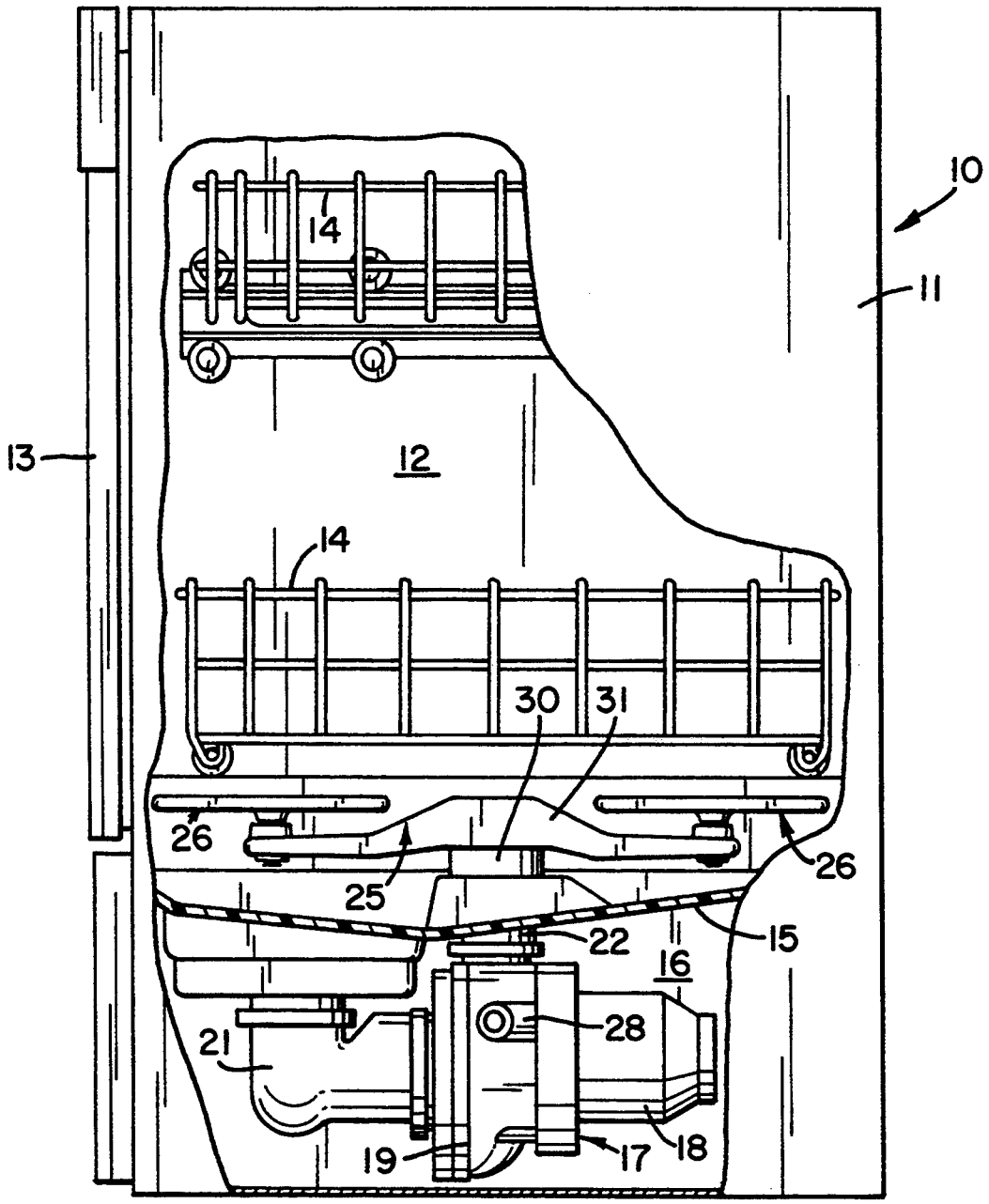
FIG. 1 is a side elevation view of an automatic domestic dish washing machine having a portion of the side wall cut away to reveal internal components.

In FIG. 1 there is illustrated an automatic domestic dish washing machine 10 including a cabinet 11 defining therein a washing chamber 12. Access to the washing chamber 12 is obtained by opening a door 13 pivoted about its lower end and positioned on the front side of the cabinet 11. Upper and lower dish supporting racks 14 are supported for slideable movement within the washing chamber 12 so that either may be separately moved outwardly to extend through the cabinet's front access opening to facilitate loading and unloading of items to be washed in the machine. A bottom wall 15 separates the lower end of the washing chamber from a lower motor-pump compartment 16. Housed within the compartment 16 is a motor-pump assembly 17 including an electric motor 18 that powers a pump 19 for recirculating washing fluid under pressure and draining washing fluid from the machine.

The operational cycle of the illustrative machine generally includes a number of rinsing and washing steps and a final drying step. Heated water from the household supply is admitted into the washing chamber 12 by valve means (not shown). The water accumulates to a predetermined level over bottom wall 15 and then a timer control means (not shown) of the machine activates the motor 18 to drive the pump 19 in a recirculation mode of operation. In the recirculation mode, the accumulated water is drained from the chamber 12 through the a conduit 21 connected to the pump 19 and then forced upwardly from the pump under pressure through a conduit 22 to a hollow elongated longitudinally disposed main spray arm 25 located in the lower portion of the chamber 12.

Generally, clean water is introduced into the machine for each wash and rinse step. Detergent is added by automatic dispensing means (not shown) for each wash step and a rinse agent may be added by an automatic dispensing means (not shown) for the final rinse step. The term "washing fluid" is therefore used herein in a generic sense to broadly refer to any form of cleansing fluid or liquid which is recirculated within the washing chamber 12 to wash or rinse items on the racks 14.

Figure 2:
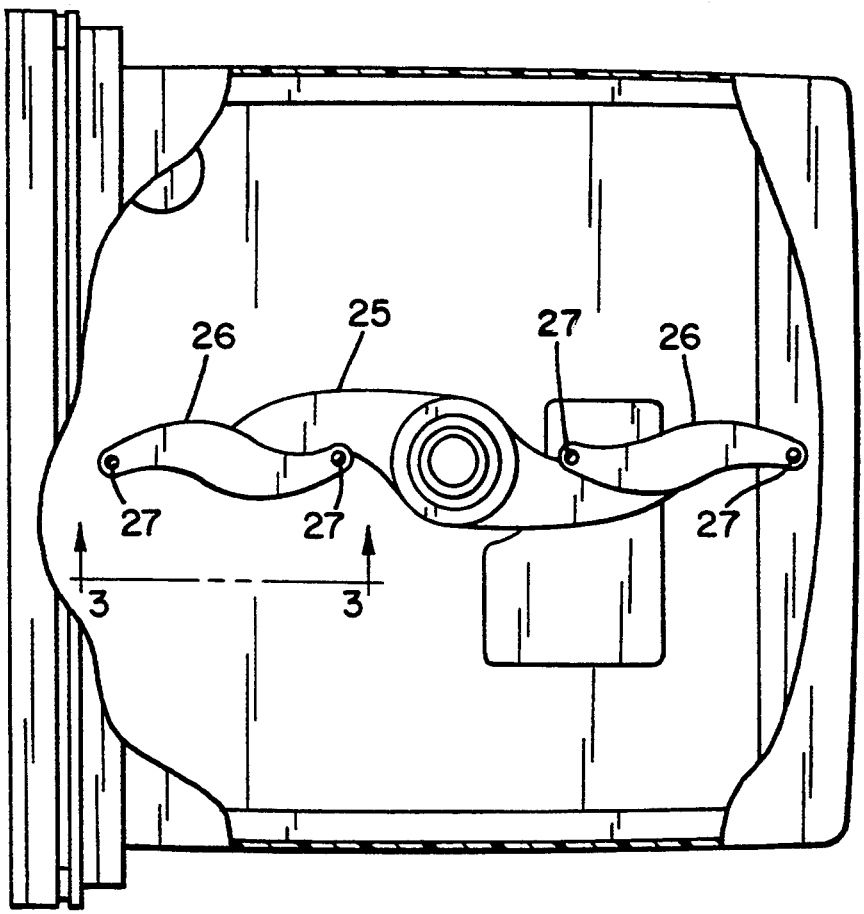
FIG. 2 is a plan view of the machine of FIG. 1, with the top wall partially broken away and with the rack mechanisms removed for purposes of illustration.

As will be described in more detail hereafter, washing fluid flows from the main arm 25 to a pair of spray devices 26, positioned adjacent each end of the arm 25. The pressurized fluid sprays generally upward from the devices 26 through exit openings 27 (see FIGS. 2–3). The main spray arm rotates about a central vertical axis defined by the axis of conduit 22 and each spray device rotates about a vertical axis through its junction with the main arm. Thus each spray device emits a hollow cylinder or cone of washing fluid which projects upwardly to impinge upon items in the racks 14. The cylinders or cones of fluid progress through the chamber in an essentially non-recurring pattern. It will be understood that for wash purposes two spray devices may be preferred because of the double washing action on the items to be washed. However, from a water conservation point of view, a single spray device will use significantly less water and normally will provide fully acceptable washing action.

The recirculation of the washing fluid from the washing chamber 12, through the pump 19, main spray arm 25 and spray devices 26 continues for a predetermined time, after which the electric circuit to motor 18 is interrupted to halt the washing action. Thereafter, a drain valve (not shown) is automatically opened and the motor 18 is energized so that the pump 19 withdraws fluid from the chamber 12 and discharges it through a drain connection 28 leading to the household sewage system.

Figure 3:
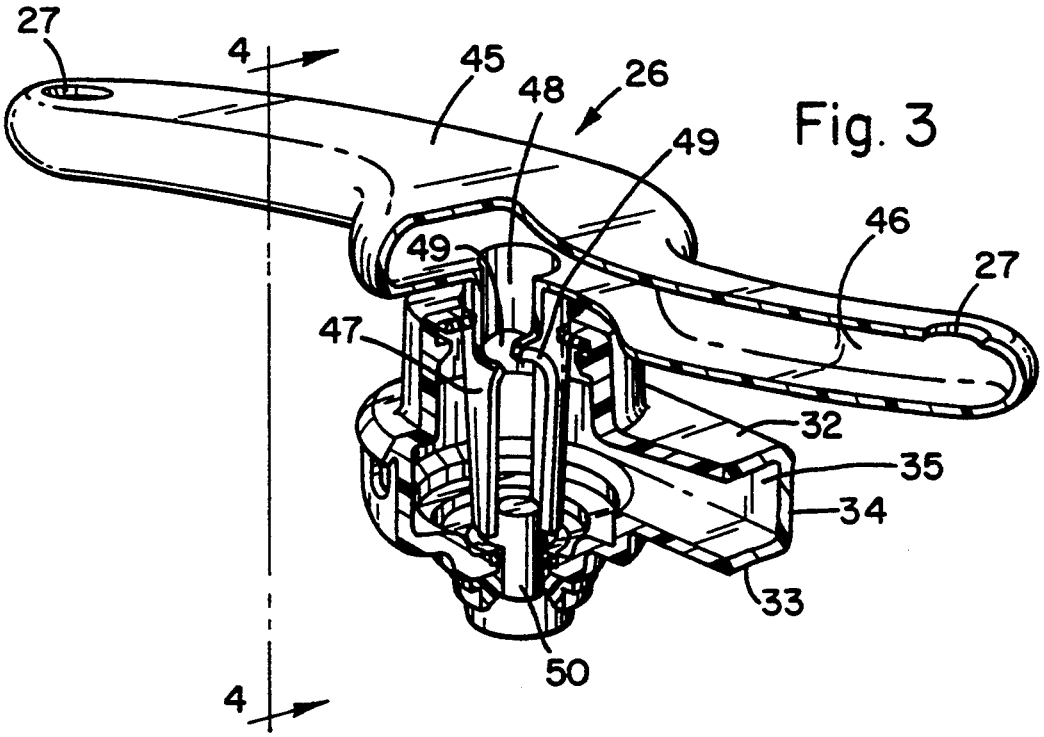
FIG. 3 is a fragmentary side elevation view of the spray mechanism of the machine as seen along line 3—3 in FIG. 2.
Figure 5:
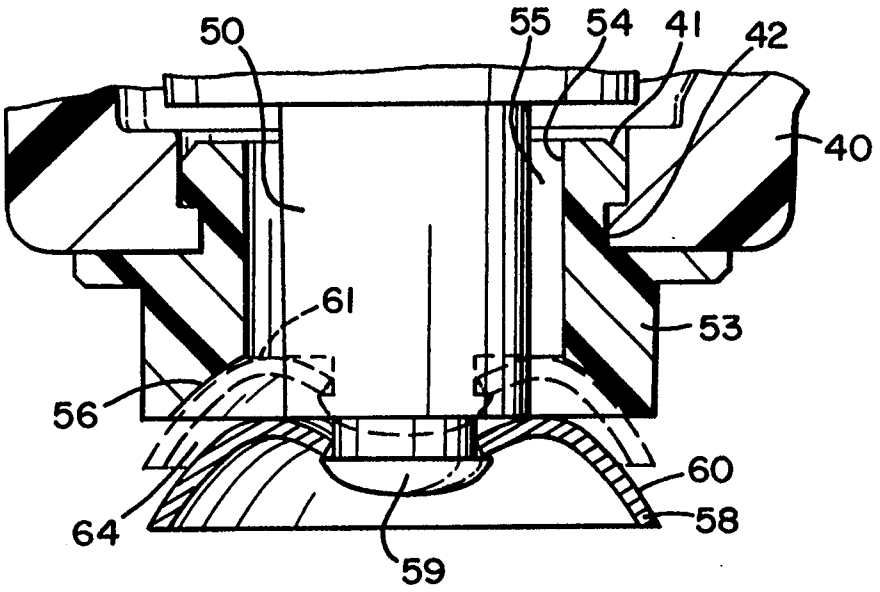
FIG. 5 is an enlarged fragmentary view illustrating the bearing mechanism between the main arm and the spray device when the spray device is in its operating position.
Figure 4:
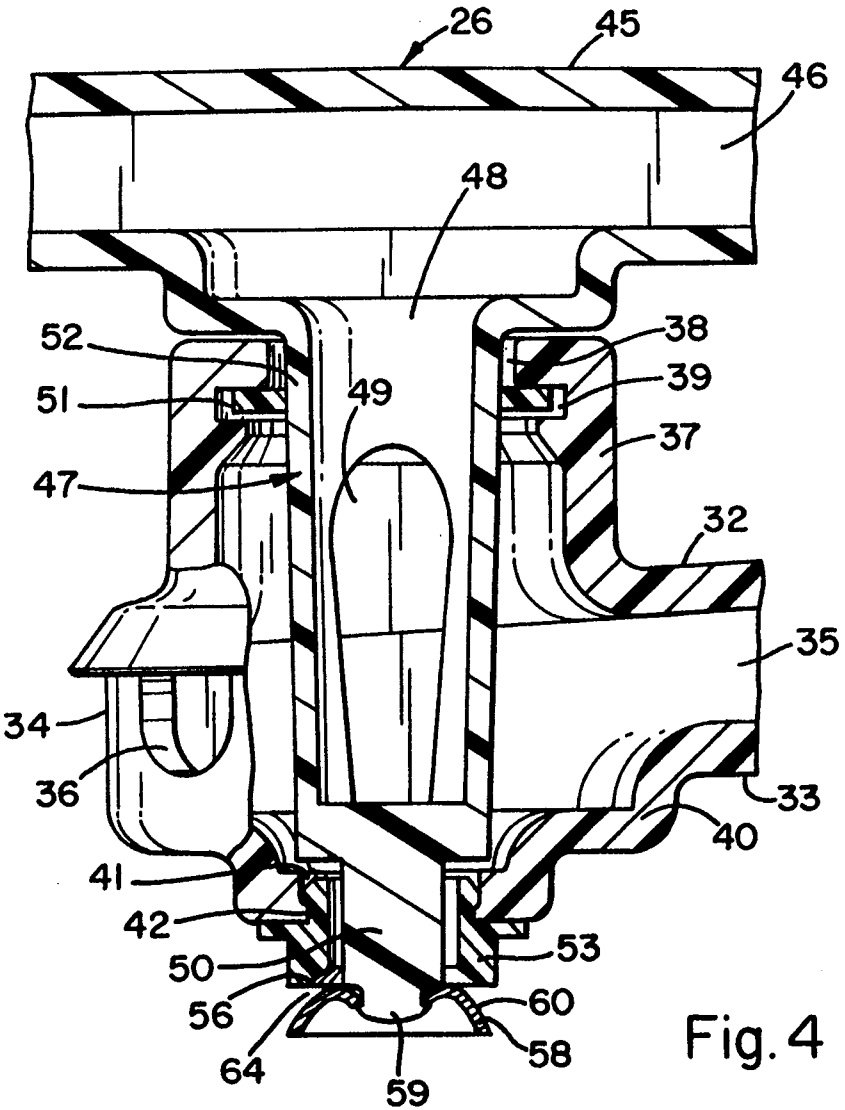
FIG. 4 is a fragmentary view as seen along line 4—4 in FIG. 3, illustrating details of the junction between the main spray arm and a spray device, with the spray device in its rest position.

Referring now to FIGS. 1–5, an improved spray system incorporating one form of the present invention includes main spray arm 25 and spray devices 26. The main arm 25 includes a central hub 30, which mounts in fluid tight relationship on conduit 22, and a horizontally disposed elongated body 31. Both the hub and body are hollow so that fluid from conduit 22 will completely fill the arm 25. As best seen in FIGS. 3 and 4, the body 31 includes top and bottom walls 32, 33 joined by a side wall 34 to define a passageway 35 that extends throughout the length of the body portion 31. A reaction or propulsion port or opening 36 is formed in side wall 34 adjacent one end of body 31. The fluid exiting port 36 exerts a reaction force on the arm 25. Port 36 is angled so that fluid exiting through the port is directed essentially tangential to the circular path of the arm 25 as it rotates about the center line of conduit 22 and thus hub 30. This maximizes the effect of the fluid and thus minimizes the amount of fluid needed to rotate the arm 25. Adjacent each end of body 31 the top wall 32 is provided with an upwardly projecting hub 37 defining a central opening 38 communicating with passageway 35. An annular recess 39 is formed on the inside of the hub 38 near its top. Also the bottom wall 33 is provided with a downwardly projecting hub 40 defining a central opening 41. An annular rib 42 projects into the opening 41. Conveniently the main arm 25 extends substantially completely across the inside of washing chamber 12 and can be in the order of about twenty-two inches long. Thus the center of openings 38, 41 at one end are about twenty inches from the center of the openings at the other end.

Referring now to FIG. 3, each of the spray devices 26 includes a hollow body portion 45 defining an elongated passageway 46, which extends from end to end of the body 45. A hollow shaft 47 extends perpendicularly from the center of body 46. Shaft 47 includes a hollow passageway 48 that connects with the passageway 46. A number of lateral openings 49 are defined in the shaft 47 and communicate with the passageway 48. Below the passageway 48 the shaft includes a solid cylindrical lower portion or hub 50.

Each spray device 26 is rotatably mounted on the main spray arm 25 by inserting its shaft 47 through the openings 38, 41 in a corresponding pair of hubs 37, 40 respectively. A split ring 51 is mounted in the annular recess 39 of the upper hub 37 and engages the solid side wall 52 of shaft 47 above the lateral openings 49. A bearing 53 is mounted on the rib 42 of bottom hub 40 and includes a longitudinal cylindrical opening 54 which surrounds the cylindrical hub 50. The hub and bearing wall of the opening 54 define an open, generally cylindrical annulus 55 around the hub 50. The downwardly facing lower surface 56 of the bearing 53 is provided with a spherical shape of a predetermined radius. A thrust washer 58 is fixedly mounted to a nib 59 on the bottom shaft hub 50. The upper surface 60 of thrust washer 58 is formed with a spherical shape of a predetermined radius slightly smaller than the radius of lower surface 56 of bearing 53. Thus when the shaft 47 rises, as will be explained in more detail hereafter, the bearing lower surface 56 and washer upper surface 60 form an essentially line contact, as indicated at 61.

With this construction, pressurized washing fluid from pump 19 flows through conduit 22 and main arm 25, enters each spray device 26 through the lateral openings 49 in its shaft 47, fills the passageways 46, 48 and exits or sprays out through the exit openings 27. The exit openings 27 are directed generally upward so that the washing fluid will form an upwardly projecting cylinder. However each opening is canted just slightly to the side, that is perpendicular to an axis through the center of both openings 27 of that spray device. Thus a reaction force from the fluid exiting the device 26 will cause it to rotate about an axis defined by the longitudinal axis of shaft 47. The spray devices are much shorter then a typical main spray arm in prior art domestic dish washing machines. For example, in an exemplary machine the main body portion 45 of each device 26 is about seven inches long. This means that each exit opening 27 is slightly less than three and one-half inches from the axis of rotation of the device 26. Thus, as the coriolis torque is proportional to the radius of the exit from the axis of rotation, the coriolis torque is much smaller than in a typical main spray arm.

The washing fluid exerts force both upward and downward on the spray device and the net force is transferred from the device 26 to the bearing 53 through the line contact area 61. The upward force from the pressurized fluid in a device 26 is determined by the area within the central opening 38 of hub 37 at its interface with split ring 51. The counterpart downward force is determined by the area within the line contact 61. Since the area within opening 38 is larger than the area within line contact 61, the net force acts on the device 26 in an upward direction. Some additional small downward force on device 26 results as a reaction to fluid exiting through the openings 27. However, the parameters of the system preferably are chosen so that there is always a net force upwardly on the spray devices 26 when fluid is flowing through them. This net upward force will cause the device 26 to rise slightly and bring the upper surface 60 of thrust washer 58 into firm contact with the lower surface 56 of the bearing 53, as at line contact 61. This contact and the shape of these mating surfaces cause the bearing mechanism or arrangement to be self centering. That is, thrust washer 58 centers itself relative to the bearing 53 and thus center hub 50 of shaft 47 is centered within the central opening 54 of bearing 53. Thus any time fluid is flowing through the system, the annulus 55 has an essentially uniform width (the width being the difference between the radius of hub 50 and opening 54).

Small food and other debris particles very often become entrained in the washing fluid. If such particles become wedged in annulus 55 they will cause the friction torque of the bearing to rise significantly for some period and, if they scar the inside of a bearing, they could cause a permanent increase in the friction torque. Such small hard pieces of debris include, for example, items such as raspberry or blackberry seeds and small particles of bone. According to one aspect of the present invention the width of the annulus 55 is slightly larger than the largest dimension of any such small piece of debris likely to be entrained in the washing fluid and the annulus width is essentially uniform. Thus any piece of debris entering the annulus will not become wedged and the bearing surface will not be scarred. Therefore the friction torque of the bearing will not increase markedly above normal.

When the pump 19 is inactivated and the pressure of the washing fluid decreases, the spray device will settle slightly in the main spray arm and the thrust washer will drop down from the bearing. At that time, some washing fluid will drain from the spray device through the spherical gap 64 between surfaces 56, 58 and will carry away any hard particles from the annulus 55. As another aspect of the invention the rest position distance (spherical gap 64) between upper surface 60 of washer 58 and lower bearing surface 56 (when fluid is not pressurized by pump 19) is made at least as large as and preferably slightly larger than the width of annulus 55. This relationship is illustrated in FIG. 4 and in solid line in FIG. 5.

In an exemplary mechanism the width of the annulus 55 is between about 0.040 inch and about 0.080 inch and preferably is about 0.050 inch; while the syherical gap between upper surface 58 and lower surface 56 is between about 0.045 inch and about 0.085 inch and preferably is about 0.060 inch.

It will be noted that the hollow construction of shaft 47 reduces the diameter of the support and fluid connection to the spray devices 26. Also the position of the bearing mechanism below the passageway 48 enables the bearing mechanism to have a minimum radius. This minimizes the bearing friction torque so that the coriolis torque is significantly larger, preferably at least about twice the bearing friction torque, under standard design operating conditions.

What is claimed is:

1. An automatic domestic dish washing machine including:

a washing chamber to receive articles to be washed, means for supplying pressurized washing fluid to said chamber;

an elongated main wash arm mounted for rotation about a generally vertical axis within said chamber and including top and bottom walls separated by an elongated hollow passageway adapted to receive the pressurized wash fluid, said top and bottom walls having aligned openings positioned outwardly of the axis of rotation of said wash arm;

a spray device including an elongated body defining a hollow passageway through said body with at least one exit opening for discharging wash fluid from said spray device and a hollow support shaft extending perpendicular to said body, said shaft including an elongated hollow passageway in fluid flow connection with passageway in said body and with lateral openings communicating with said elongated passageway in said shaft;

means mounting said shaft through said aligned openings in said top and bottom walls of said wash arm for rotation therein about a substantially vertical axis with said lateral openings in said shaft disposed within said hollow passageway in said wash arm whereby wash fluid from said washing fluid supply means passes through said wash arm and spray device and is discharged from said at least one exit opening; and discharge of wash fluid from said at least one exit opening causes said spray device to rotate about its vertical axis; said means mounting said spray device hollow shaft in said wash arm has a predetermined nominal net friction torque when said spray device rotates as the result of the passage of wash fluid supplied at a predetermined pressure; and the flow of wash fluid through said spray device body passageway generates a nominal coriolis torque at least about twice the nominal net friction torque.

2. An automatic domestic dish washing machine including:

a washing chamber to receive articles to be washed, means for supplying pressurized washing fluid to said chamber;

an elongated main wash arm mounted for rotation about a generally vertical axis within said chamber and including top and bottom walls separated by an elongated hollow passageway adapted to receive the pressurized wash fluid, said top and bottom walls having aligned openings positioned outwardly of the axis of rotation of said wash arm;

a spray device including an elongated body defining a hollow passageway through said body with at least one exit opening for discharging wash fluid from said spray device and a hollow support shaft extending perpendicular to said body, said shaft including an elongated hollow passageway in fluid flow connection with passageway in said body and with lateral openings communicating with said elongated passageway in said shaft;

means mounting said shaft through said aligned openings in said top and bottom walls of said wash arm for rotation therein about a substantially vertical axis with said lateral openings in said shaft disposed within said hollow passageway in said wash arm whereby wash fluid from said washing fluid supply means passes through said wash arm and spray device and is discharged from said at least one exit opening;

said means mounting said shaft includes a self centering bearing mechanism encompassing the lower portion of said shaft extending through said opening in said lower wash arm wall;

said lower portion of said shaft is cylindrical;

said self centering bearing mechanism includes a bearing mounted said wash arm and including a longitudinal opening surrounding said lower portion of said shaft, and a thrust washer attached to said shaft below said bearing;

said longitudinal bearing opening having a diameter slightly larger than said lower shaft portion to form therebetween an annulus with a width slightly greater than the largest dimension of hard waste particles likely to be entrained in the wash fluid.

3. A dish washing machine as set forth in claim 2, wherein: said spray device has an operating position in which said thrust washer engages a corresponding portion of said bearing and a rest position in which said thrust washer is spaced below said corresponding portion of said bearing a distance greater than the width of said annulus between said bearing and said lower shaft portion.

4. A dish washing machine as set forth in claim 3, wherein: the width of said annulus is between about 0.04 inch and about 0.08 inch and the rest position distance between said thrust washer and said corresponding portion of said bearing is between about 0.045 inch and about 0.085 inch.

5. A dish washing machine as set forth in claim 3, wherein: the width of said annulus is about 0.05 inch and the rest position distance between said thrust washer and said corresponding portion of said bearing is about 0.06 inch.

6. A dish washing machine as set forth in claim 2, wherein: the width of said annulus is between about 0.04 inch and about 0.08 inch.

7. A dish washing machine as set forth in claim 2, wherein: the width of said annulus is about 0.05 inch.

8. A dish washing machine as set forth in claim 2, wherein; said bearing also includes a downwardly facing generally spherical lower surface; said thrust washer having an upwardly facing generally spherical upper surface; said thrust washer upper surface engaging said bearing lower surface to center said shaft lower portion in said longitudinal bearing opening when said spray device rotates.

9. A dish washing machine as set forth in claim 8, wherein: said spray device has a rest position in which said upper surface of said thrust washer is spaced below said lower surface of said bearing a distance greater than the width of said annulus between said bearing and said lower shaft portion.

10. A dishwashing machine as set forth in claim 9, wherein: the width of said annulus is between about 0.04 inch and about 0.08 inch and the spray device rest position distance between said upper surface of said thrust washer and said lower surface of said bearing is between about 0.045 inch and about 0.085 inch.

11. A dishwashing machine as set forth in claim 9, wherein: the width of said annulus is about 0.05 inch and the spray device rest position distance between said upper surface of said thrust washer and said lower surface of said bearing is about 0.06 inch.

12. A domestic dish washing machine as set forth in claim 8, wherein the width of said annulus is between about 0.04 inch and about 0.08 inch.

13. A domestic dish washing machine as set forth in claim 8, wherein the width of said annulus is about 0.05 inch.

14. An automatic domestic dish washing machine including;

a washing chamber to receive articles to be washed, means for supplying pressurized washing fluid to said chamber;

a main wash arm including elongated top and bottom walls separated by an elongated hollow passageway adapted to receive the pressurized wash fluid said main wash arm being mounted for rotation within said chamber about a generally vertical axis midway between the ends of said elongated walls; said spray arm including at least one propulsion opening for discharging pressurized wash fluid in a direction causing rotation of said arm; said top and bottom walls having a pair of aligned mounting openings positioned adjacent each end thereof;

a pair of spray devices, each of said spray devices including an elongated body defining a hollow passageway therethrough with at least one exit opening for discharging wash fluid from said spray device and a hollow support shaft extending perpendicular to said body, said shaft including an elongated hollow passageway in fluid flow connection with said passageway in said body and with lateral openings communicating with said elongated passageway in said shaft;

means mounting said shaft of each of said spray devices through a corresponding pair of said mounting openings in said wash arm for rotation therein about a substantially vertical axis with said lateral openings in said shaft disposed within said hollow passageway in said wash arm whereby wash fluid from said washing fluid supply means passes through said wash arm and said spray device and is discharged from said exit openings;

each of said shafts having a cylindrical lower portion and said means mounting each of said shafts includes a bearing mounted to said wash arm, each of said bearings includes a longitudinal opening surrounding said corresponding lower shaft portion and a downwardly facing generally spherical lower surface and a thrust washer attached to said corresponding shaft below said corresponding bearing and having an upwardly facing generally spherical upper surface; each of said thrust washer upper surfaces engaging said corresponding bearing lower surface to center said corresponding shaft lower portion in said corresponding longitudinal bearing opening when said corresponding spray device rotates; and each longitudinal bearing opening having a diameter slightly larger than said corresponding lower shaft portion to form therebetween an annulus with a width slightly greater than the largest dimension of hard waste particles likely to be entrained in the wash fluid.

15. A dish washing machine as set forth in claim 14, wherein: each of said spray devices has a rest position in which said upper surface of said corresponding thrust washer is spaced below said lower surface of said corresponding bearing a distance greater than the width of said annulus between said bearing and said corresponding lower shaft portion.

16. A dishwashing machine as set forth in claim 15, wherein: the width of each annulus is between about 0.04 inch and about 0.08 inch and the spray device rest position distance between said upper surface of said corresponding thrust washer and said lower surface of said corresponding bearing is between about 0.045 inch and about 0.085 inch.

17. A dishwashing machine as set forth in claim 15, wherein: the width of said annulus is about 0.05 inch and the spray device rest position distance between said upper surface of said corresponding thrust washer and said lower surface of said corresponding bearing is about 0.06 inch.

18. A domestic dish washing machine as set forth in claim 14, wherein the width of each annulus is between about 0.04 inch and about 0.08 inch.

* * * * *